US008115146B2

(12) United States Patent
Oh et al.

(10) Patent No.: US 8,115,146 B2
(45) Date of Patent: Feb. 14, 2012

(54) POSITIVE TEMPERATURE COEFFICIENT HEATER

(75) Inventors: Man Ju Oh, Ulsan (KR); Duck Chae Jun, Seongnam-si (KR); Tae Soo Sung, Ansan-si (KR)

(73) Assignees: Hyundai Motor Company, Seoul (KR); Kia Motors Corporation, Seoul (KR); Modine Korea, LLC, Asan-Si (KR)

( * ) Notice: Subject to any disclaimer, the term of this patent is extended or adjusted under 35 U.S.C. 154(b) by 217 days.

(21) Appl. No.: 12/491,944

(22) Filed: Jun. 25, 2009

(65) Prior Publication Data

US 2010/0140255 A1 Jun. 10, 2010

(30) Foreign Application Priority Data

Dec. 5, 2008 (KR) ..... 10-2008-0123654

(51) Int. Cl.
*H05B 3/06* (2006.01)
*H01C 1/012* (2006.01)

(52) U.S. Cl. ..... 219/536; 219/530; 219/505; 219/544; 219/546; 219/548; 219/202; 219/485; 338/306; 338/309; 338/22 R; 392/485

(58) Field of Classification Search ..... 219/536, 219/530, 505, 544–548, 202, 485; 338/306–309, 338/22 R; 392/485
See application file for complete search history.

(56) References Cited

U.S. PATENT DOCUMENTS 7,012,225 B2 * 3/2006 Bohlender et al. ..... 219/536

FOREIGN PATENT DOCUMENTS

KR 1020020033358 A 5/2002
KR 1020030053086 A 6/2003
KR 1020040022585 A 3/2004

* cited by examiner

*Primary Examiner* — Shawntina Fuqua
(74) *Attorney, Agent, or Firm* — Morgan, Lewis & Bockius LLP

(57) ABSTRACT

A positive temperature coefficient heater may include at least one positive temperature coefficient rod having a heating module inserted into a rod case made of brass and plated with tin, at least one heat-radiating fin made of brass, plated with tin, and contacted and coupled with each of opposite outer faces of the positive temperature coefficient rod, and upper and lower housings coupled to opposite longitudinal ends of the positive temperature coefficient rod, wherein the positive temperature coefficient rod and the heat-radiating fin are joined together by soldered portions.

3 Claims, 4 Drawing Sheets

POSITIVE TEMPERATURE COEFFICIENT HEATER

CROSS-REFERENCE TO RELATED APPLICATION

The present application claims priority to Korean Patent Application Number 10-2008-123654 filed on Dec. 5, 2008, the entire contents of which application is incorporated herein for all purposes by this reference.

BACKGROUND OF THE INVENTION

1. Field of the Invention

The present invention relates to a positive temperature coefficient (PTC) heater, and more particularly, to a PTC heater in which a PTC rod and a heat-radiating fin are joined together by soldering, thereby improving a coupling force and heat transfer efficiency, increasing durability due to the improved coupling force, making it possible to remove side frames as well as a cover of the heat-radiating fin to reduce material cost and weight, particularly in which the soldering is performed in a relative low-temperature state using a tin solder, thereby preventing characteristics of a PTC element from being varied during the soldering, and thus smoothly exerting performance of the PTC element.

2. Description of Related Art

A vehicle is equipped with an air conditioning system for selectively supplying cold and warm air to the inside thereof. In the summer season, an air conditioner is actuated to supply the cold air. In the winter season, a heater is actuated to supply the warm air.

In general, the heater is based on a heating system in which a coolant heated by circulating through an engine exchanges heat with air introduced by a fan, so that warmed air is supplied to the inside of the vehicle. This heating system has high energy efficiency because it uses the heat generated from the engine.

However, in the winter season, it takes some time until the engine is heated after starting. Thus, after starting, the heating is not immediately performed. As such, for the heating, the engine often idles for a predetermined time prior to moving the vehicle until the engine is heated to raise the temperature of the coolant. This idling of the engine causes energy consumption and environmental pollution.

In order to prevent this problem, a use has been made of a method of heating the interior of the vehicle using a separate pre-heater for a predetermined time when the engine is being warmed up. A conventional heater using a heating coil effectively performs the heating due to a high quantity of heat, but its parts are frequently repaired and exchanged due to a short lifetime of the heating coil.

Thus, a heater using a positive temperature coefficient (PTC) element has recently been developed. This PTC heater has low fire danger, and can guarantee semi-permanent use due to a long lifetime. For this reason, the coverage of the PTC heater becomes very wide. Further, the PTC heater used for the pre-heater by nature generally has a relatively small capacity. Recently, there has been a tendency to develop a high capacity of PTC heater due to diversification of the vehicle and user's demand.

FIGS. 1 and 2 are schematic exploded perspective views illustrating the structure of an exemplary PTC heater.

As illustrated in FIGS. 1 and 2, the PTC heater generally includes a plurality of PTC rods 10, each of which has a built-in PTC element and an anode terminal 11 protruding from one end thereof and is electrically heated to generate heat, heat-radiating fin modules 20, which are coupled in close contact with opposite sides of the respective PTC rods 10 in pairs, cathode terminals 30 disposed in parallel between the neighboring heat-radiating fin modules 20, and upper and lower housings 40 and 50 coupled to opposite longitudinal ends of the PTC rods 10.

At this time, in order to allow the PTC rods 10, heat-radiating fin modules 20 and cathode terminals 30, all of which are disposed parallel to one another, to be coupled in close contact with each other between the upper and lower housings 40 and 50, the outermost heat-radiating fin modules 20 are mounted with side frames 60 on left-hand and right-hand outer sides thereof. In detail, the side frames 60 are curved inwards, and are coupled to the upper and lower housings 40 and 50. The PTC rods 10, heat-radiating fin modules 20 and cathode terminals 30 are coupled in close contact with one another by means of an elastic contact force of the curved side frames 60. This coupling allows elasticity and heat to be efficiently transferred among the PTC rods 10, heat-radiating fin modules 20 and cathode terminals 30. As a result, the entire structure of the PTC heater is formed.

Meanwhile, as illustrated in FIG. 1, each heat-radiating fin module 20 is for increasing efficiency with which each PTC rod 10 exchanges heat with air, and includes a heat-radiating fin 21 corrugated in a lengthwise direction so as to increase a contact area with air, a case 22 fixedly holding the heat-radiating fin 21, and a cover 23 fastened to the case 22 by bolts 24 so as to close an open side of the case 22. Here, in order to fix the heat-radiating fin 21 as a component for substantially improving the heat-exchange efficiency, the case 22 and cover 23 are separately prepared such that the heat-radiating fin 21 is prevented from being separated or moving from the PTC rod 10.

Thus, each heat-radiating fin module 20 is complicated when manufactured, and increases the number of parts, because the case 22 and cover 23 are additionally required to fix the heat-radiating fin 21. In order to solve this problem, the method of manufacturing the PTC heater is changed. For example, as illustrated in FIG. 2, a method of manufacturing each heat-radiating fin module 20' using a simple fin guide 25 and heat-radiating fin 21 has been developed. In this method, the heat-radiating fin module 20' also requires the fin guide 25 to fix the heat-radiating fin 21, and the fin guide 25 is configured so that opposite edges thereof are bent into flanges 25*a*. Although this structure can be regarded to be simpler than that of FIG. 1, the heat-radiating fin module 20' still suffers from a complicated manufacturing process and a number of parts.

Further, since this heat-radiating fin module 20 or 20' is configured so that the separate part, i.e. the case 22 or the fin guide 25, is interposed between the heat-radiating fin 21 and the PTC rod 10, heat transfer efficiency with which the heat emitted from the PTC rod 10 is transferred to the heat-radiating fin 21 is lowered. Furthermore, since the contact between the PTC rod 10 and the heat-radiating fin 21 is caused by the elastic contact force of the side frames 60, the contact is dependent upon surface roughness of the PTC rod 10 and/or the heat-radiating fin 21, and thus the heat transfer efficiency is lowered.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a positive temperature coefficient (PTC) heater, in which a PTC rod and a heat-radiating fin are joined together by soldering, thereby improving a coupling force and heat transfer efficiency, increasing durability due to the improved coupling force, making it possible to remove side frames as well as a cover of the heat-radiating fin to reduce material cost and weight, particularly in which the soldering is performed in a relative low-temperature state using a tin solder, thereby preventing characteristics of the PTC element from being varied during the soldering, and thus smoothly exerting performance of the PTC element.

In an aspect of the present invention, a method of manufacturing a positive temperature coefficient heater, may include plating a rod case of brass with tin, plating a heat-radiating fin of brass with tin, inserting a heating module into the rod case so as to assemble a positive temperature coefficient rod, temporarily coupling the positive temperature coefficient rod with the heat-radiating fin using a separate fixture, and joining the positive temperature coefficient rod and the heat-radiating fin together by means of soldering, and coupling upper and lower housings to opposite longitudinal ends of the positive temperature coefficient rod and the heat-radiating fin.

The soldering may use a lead-free solder, wherein the soldering is performed when side frames, which are linear in a longitudinal direction, are mounted on outer sides of the outermost heat-radiating fins after the positive temperature coefficient rod is temporarily coupled with the heat-radiating fin.

In another aspect of the present invention, the positive temperature coefficient heater may include at least one positive temperature coefficient rod having a heating module inserted into a rod case made of brass and plated with tin, at least one heat-radiating fin made of brass, plated with tin, and contacted and coupled with each of opposite outer faces of the positive temperature coefficient rod, and upper and lower housings coupled to opposite longitudinal ends of the positive temperature coefficient rod, wherein the positive temperature coefficient rod and the heat-radiating fin are joined together by soldered portions.

The upper and lower housings may be coupled with side frames, which are linear in a longitudinal direction, at opposite ends thereof, wherein the side frames are mounted on the outer sides of the outermost heat-radiating fins.

The rod case may have a closed cross section.

The heating module may include a PTC element, an anode terminal, and an insulator disposed in the rod case and configured to electrically insulating the anode terminal from the rod case.

According to embodiments of the present invention, since the PTC rod and the heat-radiating fin are joined together by soldering, the PTC heater improves a coupling force and heat transfer efficiency, increases durability due to the improved coupling force, makes it possible to remove the side frames as well as the cover of the heat-radiating fin to reduce material cost and weight. Particularly, the soldering is performed in a relative low-temperature state using the thin solder, thereby preventing characteristics of the PTC element from being varied during the soldering, and thus smoothly exerting performance of the PTC element.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In various embodiments, a method of manufacturing a positive temperature coefficient (PTC) heater includes plating a rod case 11 of brass with tin (S1), plating a heat-radiating fin 21 of brass with tin (S2), inserting a heating module into the rod case 11 so as to assemble a PTC rod 10 (S3), temporarily coupling the PTC rod 10 with the heat-radiating fin 21 using a separate fixture and joining the PTC rod 10 and the heat-radiating fin 21 together by means of soldering (S4 and S5), and coupling upper and lower housings 40 and 50 to opposite longitudinal ends of the PTC rod 10 and the heat-radiating fin 21 (S6).

In other embodiments, a PTC heater includes a PTC rod 10 having a heating module inserted into a rod case 11 of brass plated with tin, a heat-radiating fin 21 of brass plated with tin, and contacted and coupled with each of opposite faces of the PTC rod 10, and upper and lower housings 40 and 50 coupled to opposite longitudinal ends of the PTC rod 10, wherein the PTC rod 10 and the heat-radiating fin 21 are joined together by soldered portions.

Figure 3:
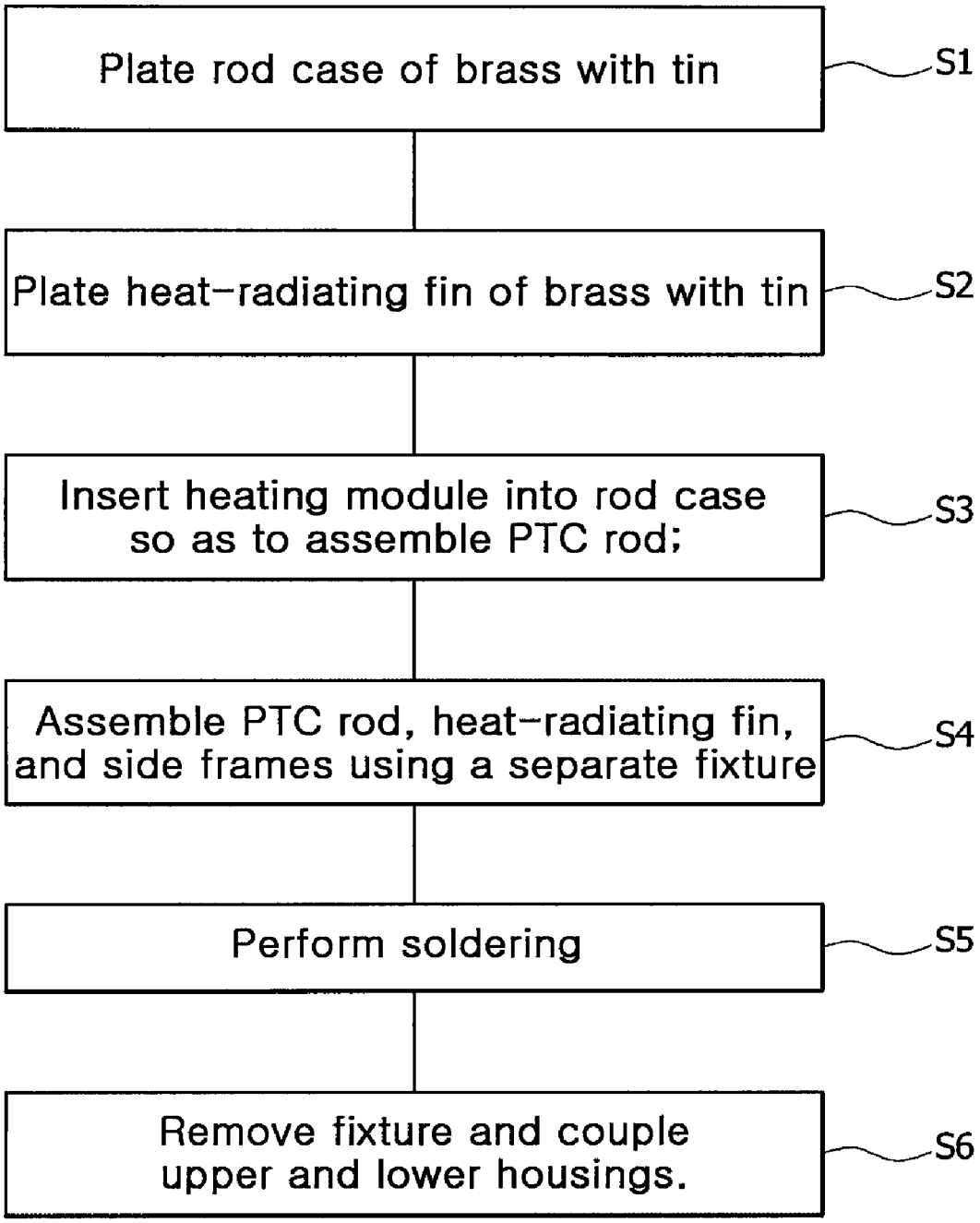
FIG. 3 is a flow chart illustrating an exemplary method of manufacturing a PTC heater according to the present invention.
Figure 4:
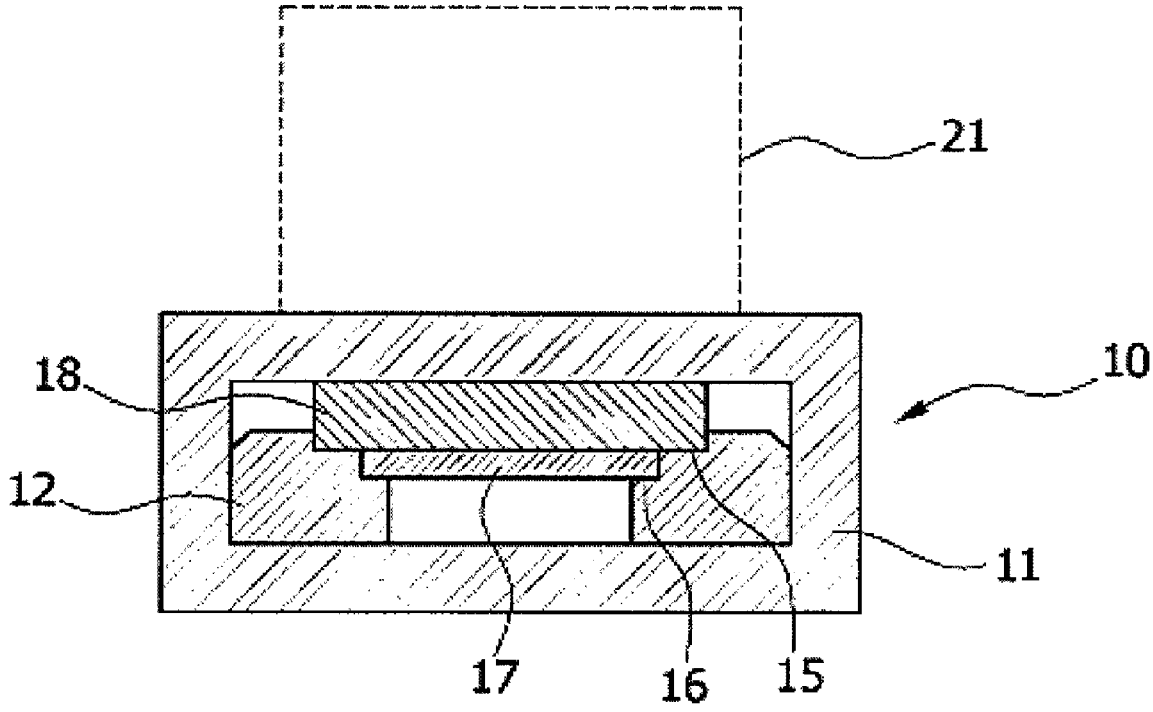
FIG. 4 is a schematic sectional view illustrating the internal structure of an exemplary PTC heater according to the present invention

FIG. 3 is a flow chart illustrating a method of manufacturing a PTC heater according to various embodiments of the present invention. FIG. 4 is a schematic sectional view illustrating the internal structure of a PTC heater according to various embodiments of the present invention.

According to various embodiments of the present invention, the PCT heater includes at least one PTC rod 10, at least one heat-radiating fin 21, and upper and lower housings 40 and 50. Cathode terminals are disposed parallel to the heat-radiating fins 21 as in the prior art. Alternatively, the cathode terminals may be separately coupled to the upper housing 40 so as to come into contact with outer sides of the PTC rods 10.

The PTC rod 10 is configured so that a heating module capable of electrically generating heat is inserted into a rod case 11. As illustrated in FIG. 4, the heating module includes a PTC element 18 electrically generating heat, an anode terminal 17 supplied with electricity, and an insulator 12 electrically insulating the anode terminal 17 from the rod case 11.

According to various embodiments of the present invention, the PCT heater is different from prior PTC heaters in that components thereof are joined together by soldering rather than by elastic contact force of side frames. Thus, the rod case 11 and the heat-radiating fin 21 are made of brass, are plated with tin (Sn), and are joined together by soldering, so that heat transfer efficiency between the PTC rod 10 and the heat-radiating fin 21 is improved.

More specifically, in the PTC heater, the PTC rod 10 has the heating module inserted into the rod case 11, which is made of brass and is plated with tin. The heat-radiating fin 21 is made of brass, is plated with tin, and is contacted and coupled with each of opposite faces of the PTC rod 10. The upper and lower housings 40 and 50 are coupled to opposite longitudinal ends of the PTC rod 10, respectively. Here, the PTC rod 10 and the heat-radiating fin 21 are joined together by soldering.

Figure 1:
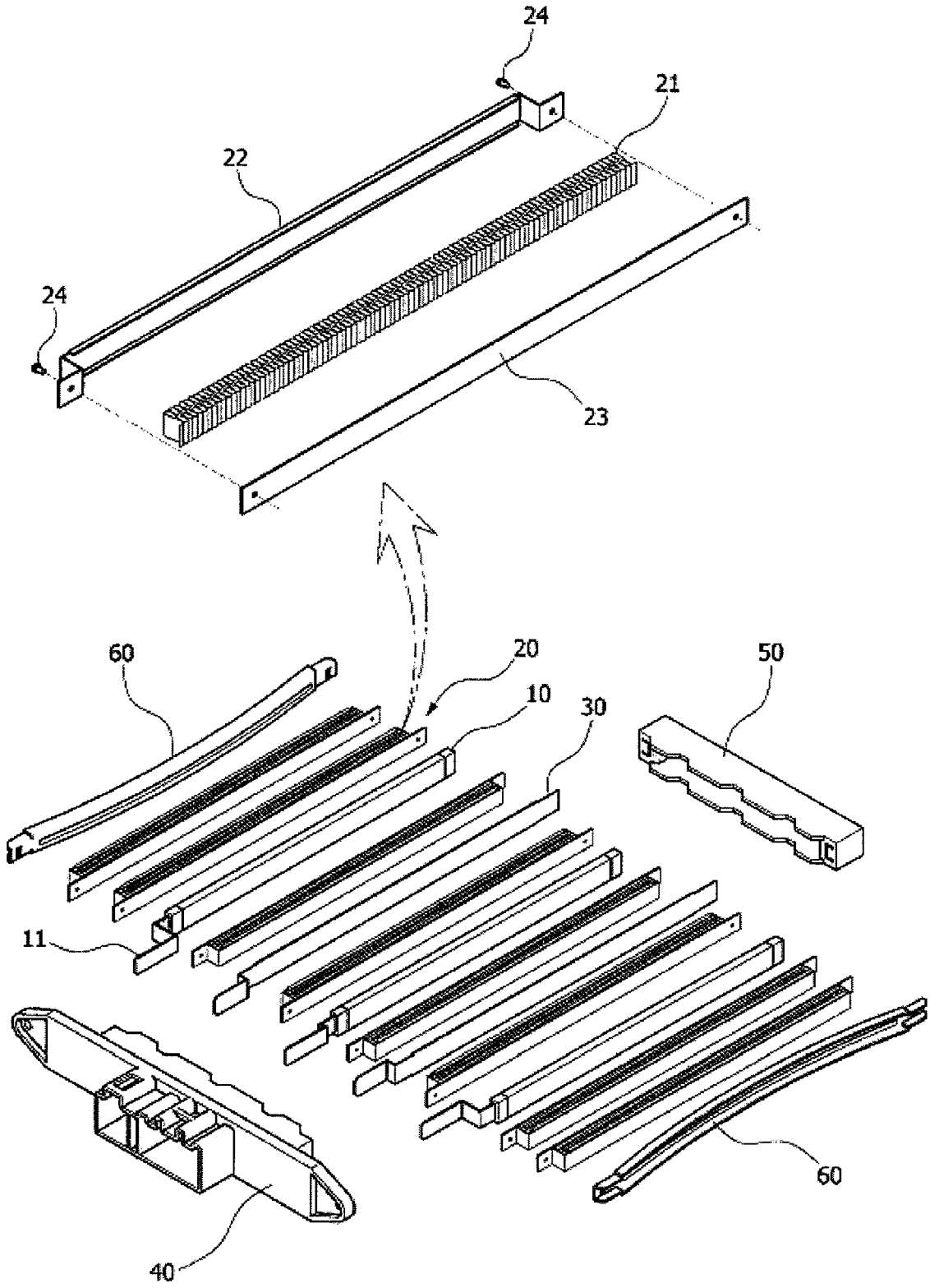
FIGS. 1 and 2 are schematic exploded perspective views illustrating an exemplary PTC heater.
Figure 2:
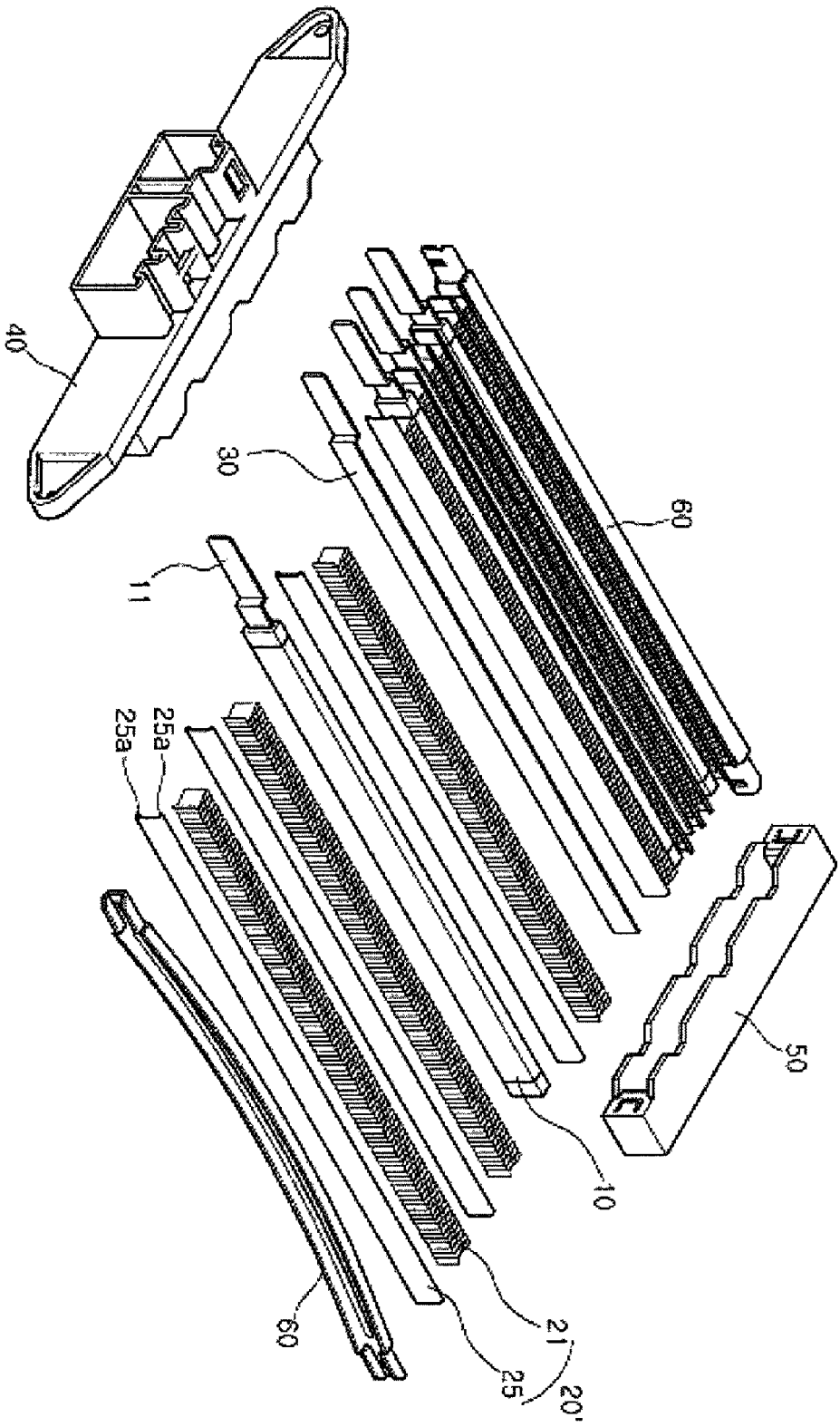

Further, the side frames 60 are disposed on outer sides of the heat-radiating fins 21 at opposite ends of the upper and lower housings 40 and 50 so as to form a frame structure along with the upper and lower housings 40 and 50 (see FIGS. 1 and 2). Since the side frames 60 are not required to apply the elastic contact force to the PTC rods 10 and the heat-radiating fins 21 unlike prior side frames, they are not curved in a longitudinal direction, but are linear in the longitudinal direction so as to be mounted in use for the frame structure.

As for a method of manufacturing the PTC heater according to various embodiments of the present invention, first, the rod case 11 is made of brass and is then plated with tin (S1). The heat-radiating fin 21 is made of brass and is then plated with tin (S2). The heating module is inserted into the rod case 11, thereby assembling the PTC rod 10 (S3). In this state, the PTC rod 10 is temporarily coupled with the heat-radiating fin 21 using a separate fixture (S4), and then the PTC rod 10 and the heat-radiating fin 21 are joined together with a solder by soldering (S5). The upper and lower housings 40 and 50 are coupled to opposite longitudinal ends of the PTC rod 10 and the heat-radiating fin 21 (S6). Thereby, the PTC heater is manufactured.

At this time, the solder for the soldering includes a lead (Pb)-free solder.

Meanwhile, the side frames can be removed from the PTC heater. However, according to various embodiments of the present invention, the side frames are mounted on the outer sides of the outermost heat-radiating fins 21. To this end, the side frames, which are linear in the longitudinal direction, are mounted on the outer sides of the outermost heat-radiating fins 21 in the state in which the PTC rod 10 is temporarily coupled with the heat-radiating fin 21 using a separate fixture. Afterwards, the side frames are soldered to the heat-radiating fins 21. However, according to other embodiments of the present invention, the PTC heater can be configured in such a manner that the side frames are not separately mounted.

According to various embodiments of the present invention, since the PTC rod and the heat-radiating fin are joined together by soldering, the PTC heater improves a coupling force and heat transfer efficiency, increases durability due to the improved coupling force, makes it possible to remove the side frames as well as the cover of the heat-radiating fin to reduce material cost and weight. Particularly, the soldering is performed in a relatively low-temperature state using the thin solder, thereby preventing characteristics of the PTC element from being varied during the soldering, and thus smoothly exerting performance of the PTC element.

For convenience in explanation and accurate definition in the appended claims, the terms "upper", "lower", "inside", and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of manufacturing a positive temperature coefficient heater, the method comprising:

plating a rod case of brass with tin;

plating a heat-radiating fin of brass with tin;

inserting a heating module into the rod case so as to assemble a positive temperature coefficient rod;

temporarily coupling the positive temperature coefficient rod with the heat-radiating fin using a separate fixture, and joining the positive temperature coefficient rod and the heat-radiating fin together by means of soldering; and coupling upper and lower housings to opposite longitudinal ends of the positive temperature coefficient rod and the heat-radiating fin.

2. The method according to claim 1, wherein the soldering uses a lead-free solder.

3. The method according to claim 2, wherein the soldering is performed when side frames, which are linear in a longitudinal direction, are mounted on outer sides of the outermost heat-radiating fins after the positive temperature coefficient rod is temporarily coupled with the heat-radiating fin.

* * * * *